US011072910B2

(12) United States Patent
Yamada et al.

(10) Patent No.: US 11,072,910 B2
(45) Date of Patent: Jul. 27, 2021

(54) WORK MACHINE

(71) Applicant: KOMATSU LTD., Tokyo (JP)

(72) Inventors: Takeo Yamada, Tokyo (JP); Shota Nakamura, Tokyo (JP); Gousuke Nakashima, Tokyo (JP)

(73) Assignee: KOMATSU LTD., Tokyo (JP)

( * ) Notice: Subject to any disclaimer, the term of this patent is extended or adjusted under 35 U.S.C. 154(b) by 628 days.

(21) Appl. No.: 15/758,059

(22) PCT Filed: Jun. 27, 2017

(86) PCT No.: PCT/JP2017/023495
§ 371 (c)(1),
(2) Date: Mar. 7, 2018

(87) PCT Pub. No.: WO2019/003289
PCT Pub. Date: Jan. 3, 2019

(65) Prior Publication Data

US 2020/0224388 A1 Jul. 16, 2020

(51) Int. Cl.

| | |
|---|---|
| ***E02F 9/22*** | (2006.01) |
| ***E02F 3/32*** | (2006.01) |
| ***E02F 3/42*** | (2006.01) |
| ***E02F 9/16*** | (2006.01) |
| ***F15B 13/06*** | (2006.01) |

(52) U.S. Cl.
CPC ..... *E02F 9/2225* (2013.01); *E02F 3/325* (2013.01); *E02F 3/425* (2013.01); *E02F 9/16* (2013.01); *E02F 9/2285* (2013.01); *F15B 13/06* (2013.01); *F15B 2211/526* (2013.01)

(58) Field of Classification Search
CPC ..... E02F 9/2225; E02F 9/16; E02F 9/2285; E02F 3/325; E02F 3/425; F15B 13/06; F15B 2211/526
See application file for complete search history.

(56) References Cited

U.S. PATENT DOCUMENTS 5,784,944 A * 7/1998 Tozawa ..... E02F 3/437 91/361
5,839,279 A * 11/1998 Moriya ..... E02F 9/2285 60/445

(Continued)

FOREIGN PATENT DOCUMENTS

| | | | |
|---|---|---|---|
| JP | H10-292425 | A | 11/1998 |
| JP | 2001-032331 | A | 2/2001 |
| JP | 2005-248569 | A | 9/2005 |

*Primary Examiner* — Saul Rodriguez
*Assistant Examiner* — Ashley K Romano
(74) *Attorney, Agent, or Firm* — Faegre Drinker Biddle & Reath LLP

(57) ABSTRACT

A plurality of electromagnetic proportional control valves are configured to control a pressure of a pilot oil generated by operation of a first control lever device and a second control lever device and, in accordance with the pressure of the pilot oil, adjust a flow rate of a hydraulic oil supplied to hydraulic cylinders. The plurality of electromagnetic proportional control valves are divided into a first valve block including at least one of the electromagnetic proportional control valves and a second valve block including at least one of the electromagnetic proportional control valves. The first valve block and the second valve block are arranged to be separated from each other.

7 Claims, 4 Drawing Sheets

(56) References Cited

U.S. PATENT DOCUMENTS

| | | | | |
|---|---|---|---|---|
| 6,246,939 | B1 * | 6/2001 | Nozawa | E02F 3/3411 172/810 |
| 6,334,308 | B1 * | 1/2002 | Sato | E02F 9/2239 60/422 |
| 10,473,125 | B2 * | 11/2019 | Nakajima | F15B 11/042 |
| 2003/0150210 | A1 * | 8/2003 | Shimada | F15B 21/14 60/484 |
| 2003/0172650 | A1 * | 9/2003 | Konishi | F15B 11/162 60/421 |
| 2005/0166429 | A1 | 8/2005 | Tanaka et al. | |
| 2008/0300757 | A1 * | 12/2008 | Kanayama | E02F 9/2285 701/50 |
| 2014/0322045 | A1 * | 10/2014 | Sakamoto | E02F 9/2235 417/364 |
| 2017/0284425 | A1 * | 10/2017 | Tanaka | E02F 3/422 |
| 2017/0350095 | A1 * | 12/2017 | Fukuda | E02F 9/2025 |
| 2018/0266082 | A1 * | 9/2018 | Tanishige | E02F 9/2285 |
| 2018/0283418 | A1 * | 10/2018 | Ishida | E02F 9/2285 |
| 2019/0040879 | A1 * | 2/2019 | Ueda | F15B 13/06 |
| 2020/0141089 | A1 * | 5/2020 | Muraoka | E02F 9/2012 |
| 2020/0318319 | A1 * | 10/2020 | Shimizu | F15B 21/082 |

* cited by examiner

WORK MACHINE

TECHNICAL FIELD

The present invention relates to a work machine.

BACKGROUND ART

As to conventional work machines, Japanese Patent Laying-Open No. 10-292425 (PTD 1) discloses a configuration in which a control valve configured to control various types of hydraulic devices is divided into a first control valve to which a control valve for a boom, a control valve for a bucket and a control valve for an arm are coupled and fixed, and a second control valve to which a control valve for revolution and a control valve for a dozer are coupled and fixed.

CITATION LIST

Patent Document

PTD 1: Japanese Patent Laying-Open No. 10-292425

SUMMARY OF INVENTION

Technical Problem

In addition, there has been devised a work machine in which a pilot oil passage is connected to a direction control valve configured to supply a hydraulic oil to a hydraulic cylinder for driving a work implement, and a pilot oil for operating the direction control valve flows through the pilot oil passage, and this pilot oil passage is provided with an electromagnetic proportional control valve configured to adjust a pressure of the pilot oil.

When a work machine includes a plurality of electromagnetic proportional control valves, it is required to appropriately arrange these plurality of electromagnetic proportional control valves on a vehicular body frame of a limited area.

An object of the present invention is to provide a work machine in which a plurality of electromagnetic proportional control valves can be appropriately arranged.

Solution to Problem

A work machine according to the present invention includes: a work implement; a plurality of hydraulic cylinders configured to drive the work implement; an operation apparatus operated to drive the hydraulic cylinders; a plurality of direction control valves configured to supply a hydraulic oil to the hydraulic cylinders to operate the hydraulic cylinders; and a plurality of electromagnetic proportional control valves. The electromagnetic proportional control valves are configured to control a pressure of a pilot oil generated by operation of the operation apparatus and, in accordance with the pressure of the pilot oil, adjust a flow rate of the hydraulic oil supplied from the direction control valves to the hydraulic cylinders. The plurality of electromagnetic proportional control valves are divided into a first valve block including at least one of the electromagnetic proportional control valves and a second valve block including at least one of the electromagnetic proportional control valves. The first valve block and the second valve block are arranged to be separated from each other.

Advantageous Effects of Invention

According to the work machine of the present invention, the plurality of electromagnetic proportional control valves can be appropriately arranged.

DESCRIPTION OF EMBODIMENTS

Figure 1:
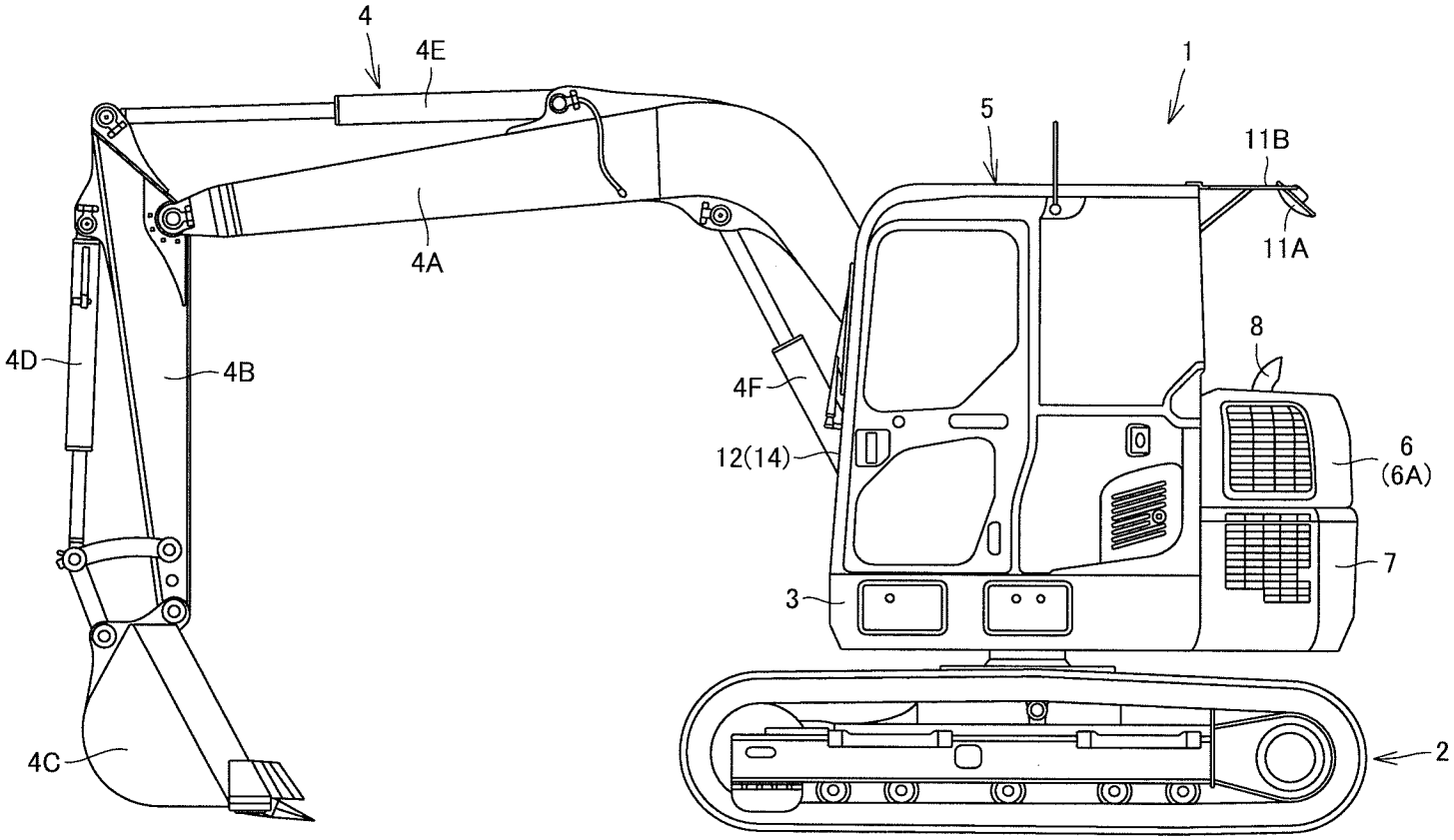
FIG. 1 is a side view schematically showing a construction of a hydraulic excavator based on an embodiment.

An embodiment will be described hereinafter with reference to the drawings. In the following description, the same components are designated by the same reference characters. Names and functions thereof are also the same. Therefore, the detailed description of them will not be repeated.

Figure 2:
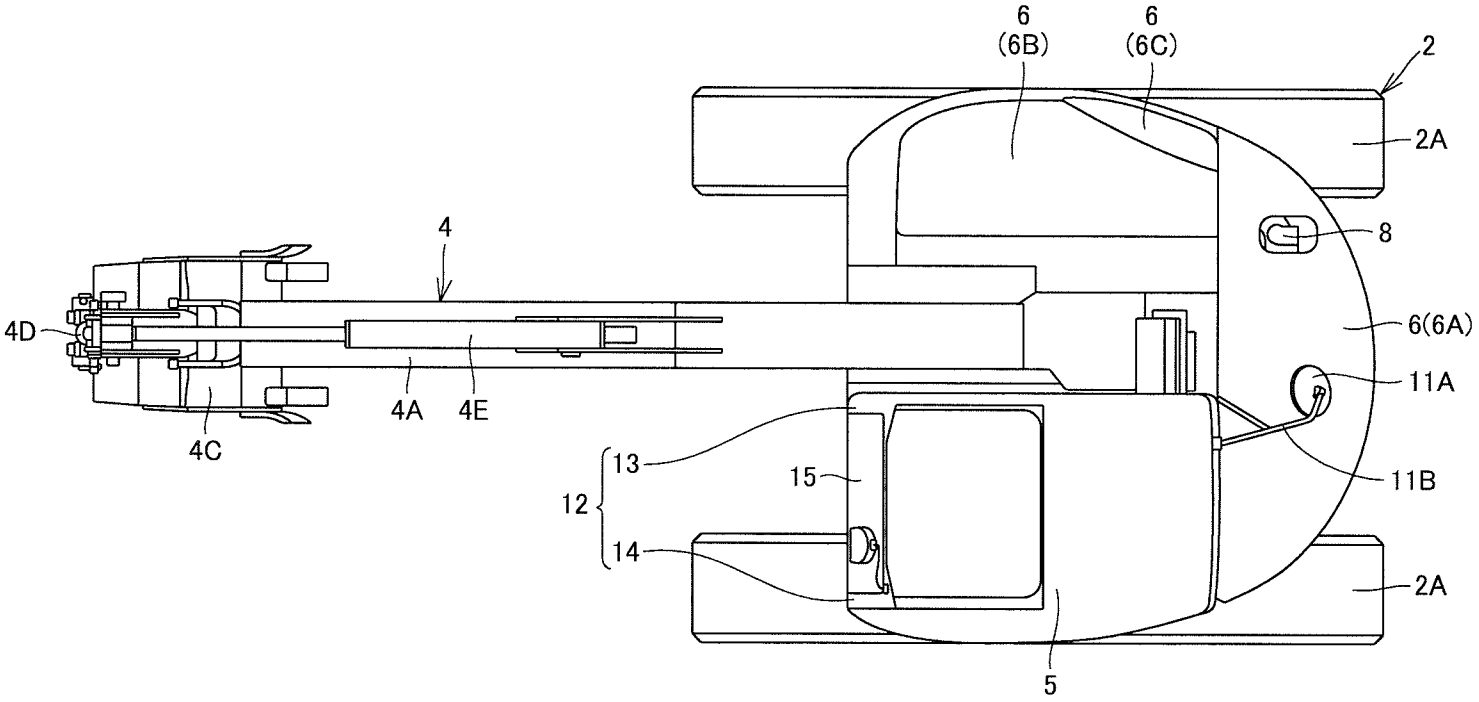
FIG. 2 is a plan view of the hydraulic excavator shown in FIG. 1.

A short tail swing hydraulic excavator 1 will be described as one example of a work machine in the embodiment. FIG. 1 is a side view schematically showing a construction of hydraulic excavator 1 based on the embodiment. FIG. 2 is a plan view of hydraulic excavator 1 shown in FIG. 1.

As shown in FIGS. 1 and 2, hydraulic excavator 1 in the present embodiment mainly has a travel unit 2, a revolving unit 3, and a work implement 4. A main body of hydraulic excavator 1 is constituted of travel unit 2 and revolving unit 3.

Travel unit 2 has a pair of left and right crawler belts 2A. Hydraulic excavator 1 is constructed to be self-propelled as the pair of left and right crawler belts 2A is rotationally driven. Revolving unit 3 is revolvably attached to travel unit 2. Revolving unit 3 mainly has a cab 5, an exterior panel 6, and a counterweight 7.

Cab 5 is arranged on a front left side of revolving unit 3 (a front side of the vehicle). An operator's compartment is formed inside cab 5. The operator's compartment is a space for an operator who gets on cab 5 to operate hydraulic excavator 1. An operator's seat for an operator to have a seat, and a below-described operation apparatus operated by an operator to drive hydraulic excavator 1 are arranged in the operator's compartment.

In the present embodiment, positional relation among components will be described with work implement 4 being defined as the reference.

A boom 4A of work implement 4 rotationally moves around a boom pin with respect to revolving unit 3. A trajectory of movement of a specific portion of boom 4A which pivots with respect to revolving unit 3, such as a tip end portion of boom 4A, is in an arc shape, and a plane including the arc is specified. When hydraulic excavator 1 is planarly viewed, the plane is shown as a straight line. A direction in which this straight line extends is a fore/aft direction of the vehicular main body of the work vehicle or a fore/aft direction of revolving unit 3, and it is also simply referred to as the fore/aft direction below. A lateral direction (a direction of vehicle width) of the vehicular main body or a lateral direction of revolving unit 3 is a direction orthogonal to the fore/aft direction in a plan view and also simply referred to as the lateral direction below. The lateral direction refers to a direction of extension of the boom pin. An upward/downward direction of the vehicular main body or an upward/downward direction of revolving unit 3 is a direction orthogonal to the plane defined by the fore/aft direction and the lateral direction and also simply referred to as the upward/downward direction below.

A side in the fore/aft direction where work implement 4 projects from the vehicular main body is defined as the fore direction, and a direction opposite to the fore direction is defined as the aft direction. A right side and a left side in the lateral direction when one faces the fore direction are defined as a right direction and a left direction, respectively. A side in the upward/downward direction where the ground is located is defined as a lower side and a side where the sky is located is defined as an upper side.

The fore/aft direction refers to a fore/aft direction of an operator who sits at the operator's seat in cab 5. The lateral direction refers to a lateral direction of the operator who sits at the operator's seat. The upward/downward direction refers to an upward/downward direction of the operator who sits at the operator's seat. A direction in which the operator sitting at the operator's seat faces is defined as the fore direction and a direction behind the operator sitting at the operator's seat is defined as the aft direction. A right side and a left side at the time when the operator sitting at the operator's seat faces front are defined as the right direction and the left direction, respectively. A foot side of the operator who sits at the operator's seat is defined as a lower side, and a head side is defined as an upper side.

Exterior panel 6 has an engine hood 6A, a soil cover 6B and a sheet metal cover 6C. Engine hood 6A, soil cover 6B and sheet metal cover 6C form a part of an upper surface of revolving unit 3. Engine hood 6A and soil cover 6B are formed to be openable and closable. Engine hood 6A and soil cover 6B are formed of a lightweight resin material. Sheet metal cover 6C is formed to be immovable relative to revolving unit 3, and is formed of a metal material such as a steel material.

Engine hood 6A and counterweight 7 are arranged on a rear side of revolving unit 3 (a rear side of the vehicle). Engine hood 6A is arranged to cover an engine compartment from above and the rear. An engine unit (such as an engine and an exhaust gas treatment unit) is accommodated in the engine compartment. Engine hood 6A is provided with an opening formed by cutting a part of engine hood 6A. An exhaust pipe 8 for discharging the exhaust gas of the engine into the air projects above engine hood 6A through this opening.

Counterweight 7 is arranged in the rear of the engine compartment for keeping balance of the main body of hydraulic excavator 1 during excavation or the like. Hydraulic excavator 1 is formed as a short tail swing hydraulic excavator having a reduced swing radius of a rear surface. Therefore, a rear surface of counterweight 7 viewed planarly is formed in an arc shape centered at the swing center of revolving unit 3.

Soil cover 6B and sheet metal cover 6C are arranged on the right of revolving unit 3. Soil cover 6B and sheet metal cover 6C are provided on the right of work implement 4.

Work implement 4 serves for such work as excavation of soil. Work implement 4 is attached on the front side of revolving unit 3. Work implement 4 has, for example, boom 4A, an arm 4B, a bucket 4C, and hydraulic cylinders 4D, 4E, and 4F. Work implement 4 can be driven as boom 4A, arm 4B, and bucket 4C are driven by respective hydraulic cylinders 4F, 4E, and 4D.

A base end portion of boom 4A is coupled to revolving unit 3 with the boom pin being interposed. Boom 4A is attached to revolving unit 3 so as to be rotatable around the boom pin in both directions with respect to revolving unit 3. Boom 4A can be operated in the upward/downward direction. A base end portion of arm 4B is coupled to a tip end portion of boom 4A with an arm pin being interposed. Arm 4B is attached to boom 4A so as to be rotatable around the arm pin in both directions with respect to boom 4A. Bucket 4C is coupled to a tip end portion of arm 4B with a bucket pin being interposed. Bucket 4C is attached to arm 4B so as to be rotatable around the bucket pin in both directions with respect to arm 4B.

Work implement 4 is provided on the right of cab 5. Arrangement of cab 5 and work implement 4 is not limited to the example shown in FIGS. 1 and 2, and for example, work implement 4 may be provided on the left of cab 5 arranged on a front right side of revolving unit 3.

Cab 5 includes a roof portion arranged to cover the operator's seat and a plurality of pillars supporting the roof portion. Each pillar has a lower end coupled to a floor portion of cab 5 and an upper end coupled to the roof portion of cab 5. The plurality of pillars have a front pillar 12 and a rear pillar. Front pillar 12 is arranged in a corner portion of cab 5 in front of the operator's seat. The rear pillar is arranged in a corner portion of cab 5 in the rear of the operator's seat.

Front pillar 12 has a right pillar 13 and a left pillar 14. Right pillar 13 is arranged at the front right corner of cab 5. Left pillar 14 is arranged at the front left corner of cab 5. Work implement 4 is arranged on the right of cab 5. Right pillar 13 is arranged on a side close to work implement 4. Left pillar 14 is arranged on a side distant from work implement 4.

A space surrounded by right pillar 13, left pillar 14, and a pair of rear pillars provides an indoor space in cab 5. The operator's seat is accommodated in the indoor space in cab 5. A door for an operator to enter and exit from cab 5 is provided in a left side surface of cab 5.

A front window 15 is arranged between right pillar 13 and left pillar 14. Front window 15 is arranged in front of the operator's seat. Front window 15 is formed of a transparent material. An operator seated at the operator's seat can visually recognize the outside of cab 5 through front window 15. For example, the operator seated at the operator's seat can directly look at bucket 4C excavating soil and existing topography to be executed through front window 15.

A mirror 11A is attached to cab 5 with a stay 11B being interposed. Mirror 11A is arranged in the rear of cab 5. Mirror 11A is arranged below the roof portion of cab 5.

Figure 3:
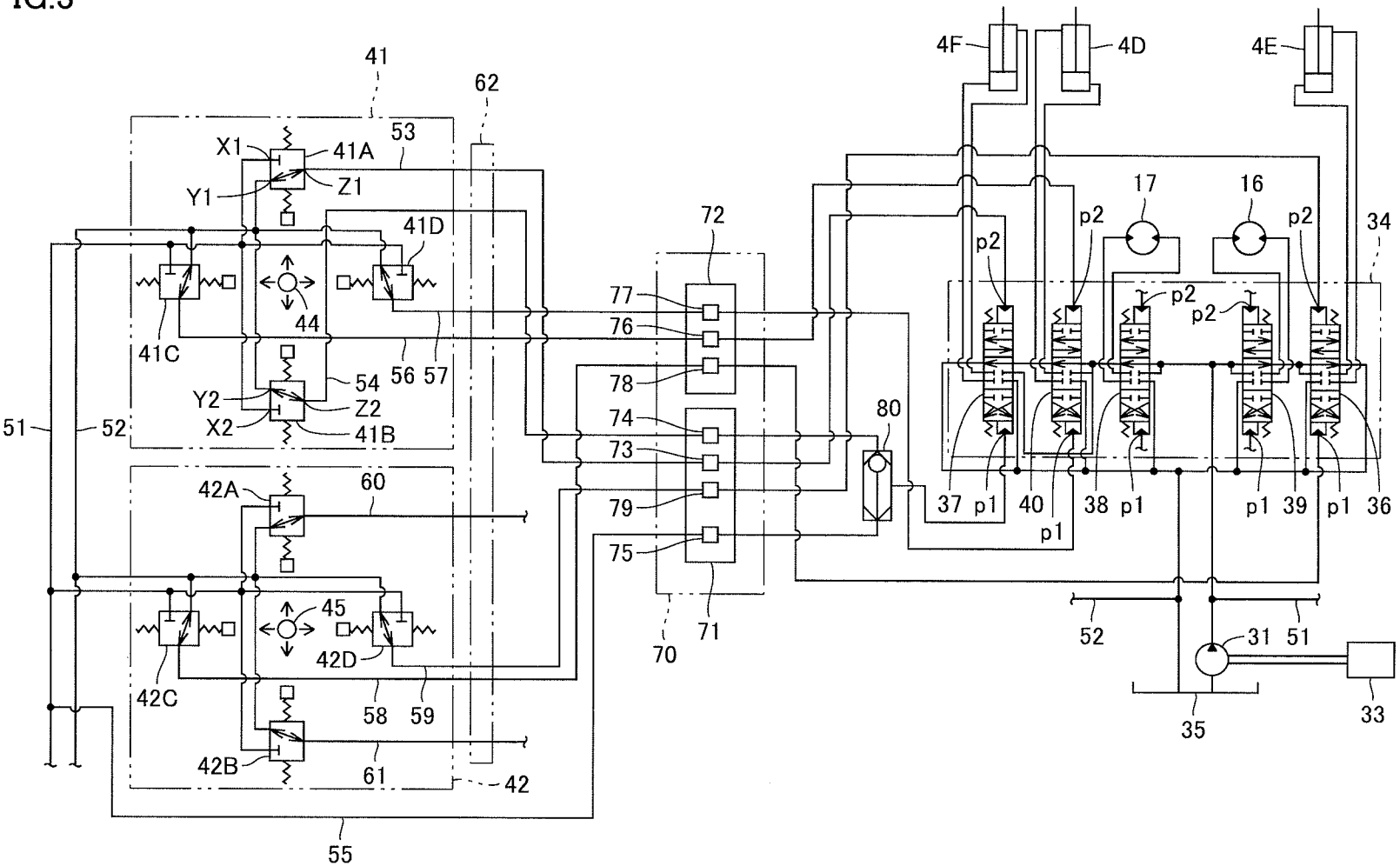
FIG. 3 is a hydraulic circuit diagram applied to the hydraulic excavator.

FIG. 3 is a hydraulic circuit diagram applied to hydraulic excavator 1. In a hydraulic system according to the present embodiment shown in FIG. 3, a hydraulic pump 31 is driven by an engine 33. Hydraulic pump 31 serves as a driving source for driving hydraulic actuators such as hydraulic cylinders 4D, 4E and 4F, travel motors 16 and 17, and the like. A part of the oil discharged from hydraulic pump 31 is supplied to the hydraulic actuators via a main operation valve 34. The oil supplied to the hydraulic actuators to actuate the hydraulic actuators is referred to as hydraulic oil. The hydraulic oil flowing out of the hydraulic actuators is discharged to a tank 35 via main operation valve 34.

Main operation valve 34 has a plurality of direction control valves. The direction control valves are actuated by the oil supplied to a first pressure receiving chamber and a second pressure receiving chamber, and control a direction of flow and an amount of flow of the hydraulic oil into each hydraulic actuator. The oil supplied to the first pressure receiving chamber and the second pressure receiving chamber to actuate the direction control valves is referred to as pilot oil. A pressure of the pilot oil is referred to as pilot pressure.

The direction control valve has a rod-like spool. The spool moves axially, and thus, the direction control valve adjusts a direction of flow of the hydraulic oil supplied to the hydraulic actuators and an amount of the hydraulic oil supplied to the hydraulic actuators per unit time. As the amount of the hydraulic oil supplied to the hydraulic actuators is adjusted, a movement speed of the hydraulic actuators is adjusted. As the movement speed of hydraulic cylinders 4D, 4E and 4F is adjusted, the speed of bucket 4C, arm 4B and boom 4A is controlled.

As shown in FIG. 3, the plurality of direction control valves include a pilot switching valve for the arm 36, a pilot switching valve for the boom 37, a pilot switching valve for left travel 38, a pilot switching valve for right travel 39, and a pilot switching valve for the bucket 40.

Pilot switching valve for the arm 36 controls supply and discharge of the hydraulic oil to and from hydraulic cylinder 4E and controls the operation of arm 4B. Pilot switching valve for the boom 37 controls supply and discharge of the hydraulic oil to and from hydraulic cylinder 4F and controls the operation of boom 4A. Pilot switching valve for left travel 38 controls supply and discharge of the hydraulic oil to and from left travel motor 17 and controls the operation of left travel motor 17. Pilot switching valve for right travel 39 controls supply and discharge of the hydraulic oil to and from right travel motor 16 and controls the operation of right travel motor 16. Pilot switching valve for the bucket 40 controls supply and discharge of the hydraulic oil to and from hydraulic cylinder 4D and controls the operation of bucket 4C.

Each of pilot switching valve for the arm 36, pilot switching valve for the boom 37, pilot switching valve for left travel 38, pilot switching valve for right travel 39, and pilot switching valve for the bucket 40 has a pair of pilot ports p1 and p2. Each of pilot switching valves 36 to 40 is controlled in accordance with the pressure of the pilot oil (pilot pressure) supplied to each pressure receiving chamber via each pilot port.

The pilot pressures applied to respective pilot ports p1 and p2 of pilot switching valve for the boom 37 and pilot switching valve for the bucket 40 are controlled by operating a first control lever device 41. The pilot pressures applied to pilot ports p1 and p2 of pilot switching valve for the arm 36 are controlled by operating a second control lever device 42. The operator operates first control lever device 41 and second control lever device 42, thereby controlling the operation of work implement 4 and the revolving operation of revolving unit 3. First control lever device 41 and second control lever device 42 constitute an operation apparatus configured to accept an operator's operation for driving work implement 4. The operation apparatus is operated to drive hydraulic cylinders 4D, 4E and 4F.

First control lever device 41 has a first control lever 44 operated by the operator. First control lever device 41 has a first pilot pressure control valve 41A, a second pilot pressure control valve 41B, a third pilot pressure control valve 41C, and a fourth pilot pressure control valve 41D. First pilot pressure control valve 41A, second pilot pressure control valve 41B, third pilot pressure control valve 41C, and fourth pilot pressure control valve 41D are provided to correspond to the four directions, i.e., the frontward-backward and left-right directions, of first control lever 44.

Each of pilot pressure control valves 41A to 41D is connected to first control lever 44. Each of pilot pressure control valves 41A to 41D outputs the pilot pressure generated by operation of first control lever 44, and controls driving of hydraulic cylinders 4D and 4F for work implement 4.

Second control lever device 42 has a second control lever 45 operated by the operator. Second control lever device 42 has a fifth pilot pressure control valve 42A, a sixth pilot pressure control valve 42B, a seventh pilot pressure control valve 42C, and an eighth pilot pressure control valve 42D. Fifth pilot pressure control valve 42A, sixth pilot pressure control valve 42B, seventh pilot pressure control valve 42C, and eighth pilot pressure control valve 42D are provided to correspond to the four directions, i.e., the frontward-backward and left-right directions, of second control lever 45.

Each of pilot pressure control valves 42A to 42D is connected to second control lever 45. Each of pilot pressure control valves 42A to 42D outputs the pilot pressure generated by operation of second control lever 45, and controls driving of hydraulic cylinder 4E for work implement 4 and a revolving motor.

First pilot pressure control valve 41A has a first pump port X1, a first tank port Y1 and a first supply/discharge port Z1.

First pump port X1 is connected to a pump flow path 51. Pump flow path 51 is connected to hydraulic pump 31. A not-shown pressure-reducing valve is provided in pump flow path 51. A part of the oil discharged from hydraulic pump 31 flows through pump flow path 51, is pressure-reduced by the pressure-reducing valve, and is supplied to first pilot pressure control valve 41A as the pilot oil.

First tank port Y1 is connected to a tank flow path 52. Tank flow path 52 is connected to tank 35. Tank 35 stores the oil.

First supply/discharge port Z1 is connected to a first pilot oil passage 53. First pilot oil passage 53 connects first pilot pressure control valve 41A of first control lever device 41 and second pilot port p2 of pilot switching valve for the boom 37.

In accordance with the operation of first control lever 44, first pilot pressure control valve 41A is switched between an output state and a discharge state. In the output state, first pilot pressure control valve 41A causes first pump port X1 and first supply/discharge port Z1 to communicate with each other, and outputs the pilot oil having a pressure corresponding to an amount of operation of first control lever 44 from first supply/discharge port Z1 to first pilot oil passage 53. In the discharge state, first pilot pressure control valve 41A causes first tank port Y1 and first supply/discharge port Z1 to communicate with each other.

Second pilot pressure control valve 41B has a second pump port X2, a second tank port Y2 and a second supply/discharge port Z2. Second pump port X2 is connected to pump flow path 51. Second tank port Y2 is connected to tank flow path 52.

Second supply/discharge port Z2 is connected to a second pilot oil passage 54. Second pilot oil passage 54 connects second pilot pressure control valve 41B of first control lever device 41 and first pilot port p1 of pilot switching valve for the boom 37.

In accordance with the operation of first control lever 44, second pilot pressure control valve 41B is switched between an output state and a discharge state. In the output state, second pilot pressure control valve 41B causes second pump port X2 and second supply/discharge port Z2 to communicate with each other, and outputs the pilot oil having a pressure corresponding to an amount of operation of first control lever 44 from second supply/discharge port Z2 to second pilot oil passage 54. In the discharge state, second pilot pressure control valve 41B causes second tank port Y2 and second supply/discharge port Z2 to communicate with each other.

First pilot pressure control valve 41A and second pilot pressure control valve 41B form a pair and correspond to the operation directions of first control lever 44 that are opposite to each other. For example, first pilot pressure control valve 41A corresponds to the operation of first control lever 44 toward the front, and second pilot pressure control valve 41B corresponds to the operation of first control lever 44 toward the rear. Either first pilot pressure control valve 41A or second pilot pressure control valve 41B is selected in accordance with the operation of first control lever 44. When one of first pilot pressure control valve 41A and second pilot pressure control valve 41B is in the output state, the other is in the discharge state.

First pilot pressure control valve 41A controls supply and discharge of the pilot oil to and from second pilot port p2 of pilot switching valve for the boom 37. Second pilot pressure control valve 41B controls supply and discharge of the pilot oil to and from first pilot port p1 of pilot switching valve for the boom 37. In accordance with the operation of first control lever 44, supply and discharge of the hydraulic oil to and from a bottom-side oil chamber and a head-side oil chamber of hydraulic cylinder 4F are controlled, and a movement amount and a movement speed of extension or contraction of hydraulic cylinder 4F are controlled.

First control lever 44 accepts a user's operation for driving boom 4A. Second pilot pressure control valve 41B outputs a hydraulic pressure signal corresponding to a user's operation for raising boom 4A. First pilot pressure control valve 41A outputs a hydraulic pressure signal corresponding to a user's operation for lowering boom 4A. The hydraulic pressure signals output by operation of first control lever 44 may include a boom-raising signal for performing the operation for raising boom 4A and a boom-lowering signal for performing the operation for lowering boom 4A. As a result, the operation for raising or lowering boom 4A is controlled in accordance with the operation of first control lever 44.

First pilot port p1 of pilot switching valve for the boom 37 has a function as a boom-raising pilot port supplied with the pilot oil at the time of the operation for raising boom 4A. Second pilot port p2 of pilot switching valve for the boom 37 has a function as a boom-lowering pilot port supplied with the pilot oil at the time of the operation for lowering boom 4A. First control lever device 41 constitutes a boom operation apparatus configured to accept an operator's operation for driving boom 4A.

A relay block 70 is provided in a hydraulic pressure path connecting first and second control lever devices 41 and 42 and main operation valve 34. Relay block 70 is configured to include a plurality of electromagnetic proportional control valves 73 to 79. Electromagnetic proportional control valve 73 is provided in first pilot oil passage 53. Electromagnetic proportional control valve 74 is provided in second pilot oil passage 54. Electromagnetic proportional control valves 73 and 74 are provided to control the operation for moving boom 4A upwardly and downwardly in accordance with the operation of first control lever 44.

In accordance with the operation of first control lever 44, a hydraulic pressure is generated in first pilot oil passage 53 between first pilot pressure control valve 41A and electromagnetic proportional control valve 73. Electromagnetic proportional control valve 73 is controlled based on this hydraulic pressure. In accordance with this hydraulic pressure, an instruction signal for ordering boom-lowering is output to electromagnetic proportional control valve 73 and the opening degree of electromagnetic proportional control valve 73 is adjusted. As a result, a flow rate of the pilot oil flowing through first pilot oil passage 53 changes and the pilot pressure transmitted to second pilot port p2 of pilot switching valve for the boom 37 is controlled. In accordance with the magnitude of the pilot pressure transmitted to second pilot port p2, the spool of pilot switching valve for the boom 37 moves. Based on an amount of this movement of the spool, an amount of the hydraulic oil supplied from pilot switching valve for the boom 37 to the head-side oil chamber of hydraulic cylinder 4F is adjusted, and a speed of boom 4A when lowering boom 4A is adjusted.

In accordance with the operation of first control lever 44, a hydraulic pressure is generated in second pilot oil passage 54 between second pilot pressure control valve 41B and electromagnetic proportional control valve 74. Electromagnetic proportional control valve 74 is controlled based on this hydraulic pressure. In accordance with this hydraulic pressure, an instruction signal for ordering boom-raising is output to electromagnetic proportional control valve 74 and the opening degree of electromagnetic proportional control valve 74 is adjusted. As a result, a flow rate of the pilot oil flowing through second pilot oil passage 54 changes and the pilot pressure transmitted to first pilot port p1 of pilot switching valve for the boom 37 is controlled. In accordance with the magnitude of the pilot pressure transmitted to first pilot port p1, the spool of pilot switching valve for the boom 37 moves. Based on an amount of this movement of the spool, an amount of the hydraulic oil supplied from pilot switching valve for the boom 37 to the bottom-side oil chamber of hydraulic cylinder 4F is adjusted, and a speed of boom 4A when raising boom 4A is adjusted.

A shuttle valve 80 is provided in second pilot oil passage 54. Shuttle valve 80 has two entrance ports and one exit port. The exit port of shuttle valve 80 is connected to first pilot port p1 of pilot switching valve for the boom 37 via second pilot oil passage 54. One entrance port of shuttle valve 80 is connected to second pilot pressure control valve 41B via second pilot oil passage 54. The other entrance port of shuttle valve 80 is connected to a pump flow path 55.

Pump flow path 55 branches off from pump flow path 51. One end of pump flow path 55 is connected to pump flow path 51 and the other end of pump flow path 55 is connected to shuttle valve 80. The pilot oil transported by hydraulic pump 31 flows to first control lever device 41 and second control lever device 42 via pump flow path 51, and also flows to shuttle valve 80 via pump flow paths 51 and 55.

Shuttle valve 80 is a shuttle valve of higher pressure priority type. Shuttle valve 80 compares the hydraulic pressure in second pilot oil passage 54 connected to one entrance port and the hydraulic pressure in pump flow path 55 connected to the other entrance port, and selects the higher pressure. Shuttle valve 80 causes a higher pressure-side flow path of second pilot oil passage 54 and pump flow path 55 to communicate with the exit port, and supplies the pilot oil flowing through this higher pressure-side flow path to first pilot port p1 of pilot switching valve for the boom 37.

An electromagnetic proportional control valve 75 is provided in pump flow path 55. Electromagnetic proportional control valve 75 is included in relay block 70. Regardless of the operation of first control lever device 41 by the operator, electromagnetic proportional control valve 75 receives an instruction signal output from a controller and adjusts the opening degree thereof. In accordance with a change in opening degree of electromagnetic proportional control valve 75, a flow rate of the pilot oil flowing through pump flow path 55 changes.

In the case of normal control in which intervention control is not executed, electromagnetic proportional control valve 75 is fully closed. When the hydraulic pressure in second pilot oil passage 54 is higher than the hydraulic pressure in pump flow path 55 at the entrance of shuttle valve 80, shuttle valve 80 causes second pilot oil passage 54 to communicate with the exit port. The pilot oil in second pilot oil passage 54 is supplied to first pilot port p1 of pilot switching valve for the boom 37.

When intervention control is executed to prevent a cutting edge of bucket 4C from entering design topography, the pilot pressures adjusted by electromagnetic proportional control valves 74 and 75 are transmitted to first pilot port p1 of pilot switching valve for the boom 37. In the case where the cutting edge of bucket 4C moves to be lower than design topography and enters the design topography when work implement 4 is operated in accordance with the operation of first control lever 44, control for forcibly raising boom 4A is executed. In this case, electromagnetic proportional control valve 75 enters an open state and the high-pressure pilot oil in pump flow path 55 is supplied to first pilot port p1 of pilot switching valve for the boom 37.

Both second pilot oil passage 54 and pump flow path 55 have a function as a boom-raising pilot oil passage. More specifically, second pilot oil passage 54 functions as a normal boom-raising pilot oil passage, and pump flow path 55 functions as a forcible boom-raising pilot oil passage. Electromagnetic proportional control valve 74 provided in second pilot oil passage 54 can be expressed as a normal boom-raising electromagnetic proportional control valve, and electromagnetic proportional control valve 75 provided in pump flow path 55 can be expressed as a forcible boom-raising electromagnetic proportional control valve. Electromagnetic proportional control valve 75 is a valve for forcible boom-raising intervention. By adjusting the opening degree of electromagnetic proportional control valve 75, the operation for forcibly raising boom 4A is controlled.

Third pilot pressure control valve 41C and fourth pilot pressure control valve 41D have configurations similar to those of first pilot pressure control valve 41A and second pilot pressure control valve 41B described above. Similarly to first pilot pressure control valve 41A and second pilot pressure control valve 41B, third pilot pressure control valve 41C and fourth pilot pressure control valve 41D form a pair, and either third pilot pressure control valve 41C or fourth pilot pressure control valve 41D is selected in accordance with the operation of first control lever 44. For example, third pilot pressure control valve 41C corresponds to the operation of first control lever 44 toward the left, and fourth pilot pressure control valve 41D corresponds to the operation of first control lever 44 toward the right.

Third pilot pressure control valve 41C is connected to pump flow path 51, tank flow path 52 and a third pilot oil passage 56. Third pilot oil passage 56 connects third pilot pressure control valve 41C of first control lever device 41 and second pilot port p2 of pilot switching valve for the bucket 40. Fourth pilot pressure control valve 41D is connected to pump flow path 51, tank flow path 52 and a fourth pilot oil passage 57. Fourth pilot oil passage 57 connects fourth pilot pressure control valve 41D of first control lever device 41 and first pilot port p1 of pilot switching valve for the bucket 40.

Third pilot pressure control valve 41C controls supply and discharge of the pilot oil to and from second pilot port p2 of pilot switching valve for the bucket 40. Fourth pilot pressure control valve 41D controls supply and discharge of the pilot oil to and from first pilot port p1 of pilot switching valve for the bucket 40. In accordance with the operation of first control lever 44, supply and discharge of the hydraulic oil to and from the bottom-side oil chamber and the head-side oil chamber of hydraulic cylinder 4D are controlled, and a movement amount and a movement speed of extension or contraction of hydraulic cylinder 4D are controlled.

First control lever 44 accepts a user's operation for driving bucket 4C. First control lever device 41 constitutes a bucket operation apparatus configured to accept an operator's operation for driving bucket 4C.

Fourth pilot pressure control valve 41D outputs a hydraulic pressure signal corresponding to a user's operation for moving bucket 4C in a dump direction in which the cutting edge of bucket 4C moves away from revolving unit 3. Third pilot pressure control valve 41C outputs a hydraulic pressure signal corresponding to a user's operation for moving bucket 4C in an excavation direction in which the cutting edge of bucket 4C moves close to revolving unit 3. The hydraulic pressure signals output by operation of first control lever 44 may include a bucket dump signal for causing bucket 4C to perform a dump operation and a bucket excavation signal for causing bucket 4C to perform an excavation operation. As a result, the operation of bucket 4C in the excavation direction or in the dump direction is controlled in accordance with the operation of first control lever 44.

An electromagnetic proportional control valve 76 is provided in third pilot oil passage 56. In accordance with a pressure of the pilot oil supplied to third pilot oil passage 56 via third pilot pressure control valve 41C, electromagnetic proportional control valve 76 controls the pilot pressure transmitted to second pilot port p2 of pilot switching valve for the bucket 40. In accordance with the magnitude of the pilot pressure transmitted to second pilot port p2, the spool of pilot switching valve for the bucket 40 moves. Based on an amount of this movement of the spool, an amount of the hydraulic oil supplied from pilot switching valve for the bucket 40 to the bottom-side oil chamber of hydraulic cylinder 4D is adjusted, and a speed of bucket 4C when moving bucket 4C in the excavation direction is adjusted.

An electromagnetic proportional control valve 77 is provided in fourth pilot oil passage 57. In accordance with a pressure of the pilot oil supplied to fourth pilot oil passage 57 via fourth pilot pressure control valve 41D, electromagnetic proportional control valve 77 controls the pilot pressure transmitted to first pilot port p1 of pilot switching valve for the bucket 40. In accordance with the magnitude of the pilot pressure transmitted to first pilot port p1, the spool of pilot switching valve for the bucket 40 moves. Based on an amount of this movement of the spool, an amount of the hydraulic oil supplied from pilot switching valve for the bucket 40 to the head-side oil chamber of hydraulic cylinder 4D is adjusted, and a speed of bucket 4C when moving bucket 4C in the dump direction is adjusted.

Fifth pilot pressure control valve 42A, sixth pilot pressure control valve 42B, seventh pilot pressure control valve 42C, and eighth pilot pressure control valve 42D have configurations similar to those of first pilot pressure control valve 41A, second pilot pressure control valve 41B, third pilot pressure control valve 41C, and fourth pilot pressure control valve 41D described above. Fifth pilot pressure control valve 42A and sixth pilot pressure control valve 42B form a pair, and either fifth pilot pressure control valve 42A or sixth pilot pressure control valve 42B is selected in accordance with the operation of second control lever 45. Seventh pilot pressure control valve 42C and eighth pilot pressure control valve 42D form a pair, and either seventh pilot pressure control valve 42C or eighth pilot pressure control valve 42D is selected in accordance with the operation of second control lever 45.

For example, fifth pilot pressure control valve 42A corresponds to the operation of second control lever 45 toward the front, and sixth pilot pressure control valve 42B corresponds to the operation of second control lever 45 toward the rear. Seventh pilot pressure control valve 42C corresponds to the operation of second control lever 45 toward the left, and eighth pilot pressure control valve 42D corresponds to the operation of second control lever 45 toward the right.

Fifth pilot pressure control valve 42A is connected to pump flow path 51, tank flow path 52 and a fifth pilot oil passage 60. Sixth pilot pressure control valve 42B is connected to pump flow path 51, tank flow path 52 and a sixth pilot oil passage 61. A not-shown hydraulic motor for revolving revolving unit 3 is controlled based on the pressure of the pilot oil supplied to fifth pilot oil passage 60 via fifth pilot pressure control valve 42A and the pressure of the pilot oil supplied to sixth pilot oil passage 61 via sixth pilot pressure control valve 42B. Rotational driving of this hydraulic motor when the pilot oil is supplied to fifth pilot oil passage 60 is opposite to rotational driving of the hydraulic motor when the pilot oil is supplied to sixth pilot oil passage 61. In accordance with the direction of operation and the amount of operation of second control lever 45, the revolving direction and the revolving speed of revolving unit 3 are controlled.

Seventh pilot pressure control valve 42C is connected to pump flow path 51, tank flow path 52 and a seventh pilot oil passage 58. Seventh pilot oil passage 58 connects seventh pilot pressure control valve 42C of second control lever device 42 and first pilot port p1 of pilot switching valve for the arm 36. Eighth pilot pressure control valve 42D is connected to pump flow path 51, tank flow path 52 and an eighth pilot oil passage 59. Eighth pilot oil passage 59 connects eighth pilot pressure control valve 42D of second control lever device 42 and second pilot port p2 of pilot switching valve for the arm 36.

Seventh pilot pressure control valve 42C controls supply and discharge of the pilot oil to and from first pilot port p1 of pilot switching valve for the arm 36. Eighth pilot pressure control valve 42D controls supply and discharge of the pilot oil to and from second pilot port p2 of pilot switching valve for the arm 36. In accordance with the operation of second control lever 45, supply and discharge of the hydraulic oil to and from the bottom-side oil chamber and the head-side oil chamber of hydraulic cylinder 4E are controlled, and a movement amount and a movement speed of extension or contraction of hydraulic cylinder 4E are controlled.

Second control lever 45 accepts a user's operation for driving arm 4B. Second control lever device 42 constitutes an arm operation apparatus configured to accept an operator's operation for driving arm 4B.

Eighth pilot pressure control valve 42D outputs a hydraulic pressure signal corresponding to a user's operation for moving arm 4B in an arm excavation direction in which arm 4B moves close to revolving unit 3. Seventh pilot pressure control valve 42C outputs a hydraulic pressure signal corresponding to a user's operation for moving arm 4B in an arm dump direction in which arm 4B moves away from revolving unit 3. The hydraulic pressure signals output by operation of second control lever 45 may include an arm dump signal for causing arm 4B to perform a dump operation and an arm excavation signal for causing arm 4B to perform an excavation operation. As a result, the operation of arm 4B in the excavation direction or in the dump direction is controlled in accordance with the operation of second control lever 45.

An electromagnetic proportional control valve 78 is provided in seventh pilot oil passage 58. In accordance with a pressure of the pilot oil supplied to seventh pilot oil passage 58 via seventh pilot pressure control valve 42C, electromagnetic proportional control valve 78 controls the pilot pressure transmitted to first pilot port p1 of pilot switching valve for the arm 36. In accordance with the magnitude of the pilot pressure transmitted to first pilot port p1, the spool of pilot switching valve for the arm 36 moves. Based on an amount of this movement of the spool, an amount of the hydraulic oil supplied from pilot switching valve for the arm 36 to the head-side oil chamber of hydraulic cylinder 4E is adjusted, and a speed of arm 4B when moving arm 4B in the arm dump direction is adjusted.

An electromagnetic proportional control valve 79 is provided in eighth pilot oil passage 59. In accordance with a pressure of the pilot oil supplied to eighth pilot oil passage 59 via eighth pilot pressure control valve 42D, electromagnetic proportional control valve 79 controls the pilot pressure transmitted to second pilot port p2 of pilot switching valve for the arm 36. In accordance with the magnitude of the pilot pressure transmitted to second pilot port p2, the spool of pilot switching valve for the arm 36 moves. Based on an amount of this movement of the spool, an amount of the hydraulic oil supplied from pilot switching valve for the arm 36 to the bottom-side oil chamber of hydraulic cylinder 4E is adjusted, and a speed of arm 4B when moving arm 4B in the arm excavation direction is adjusted.

A pattern switching valve 62 is provided in a hydraulic pressure path between first and second control lever devices 41 and 42 and relay block 70. By operating pattern switching valve 62, the setting of a correspondence relation between the operation directions of first and second control levers 44 and 45 and the operation of work implement 4 and the revolving operation of revolving unit 3 can be switched to a desired pattern. For example, by operating pattern switching valve 62, the operation of first control lever 44 in the fore/aft direction can correspond to the upward and downward movement of boom 4A, or can correspond to the movement of arm 4B in the excavation direction and in the dump direction.

Relay block 70 configured to include the plurality of electromagnetic proportional control valves 73 to 79 is divided into a first valve block 71 and a second valve block 72. First valve block 71 includes boom-lowering electromagnetic proportional control valve 73, normal boom-raising electromagnetic proportional control valve 74, forcible boom-raising electromagnetic proportional control valve 75, and arm excavation electromagnetic proportional control valve 79. Second valve block 72 includes bucket excavation electromagnetic proportional control valve 76, bucket dump electromagnetic proportional control valve 77, and arm dump electromagnetic proportional control valve 78.

Electromagnetic proportional control valves 73, 74, 75, and 79 included in first valve block 71 are coupled and fixed to one another and formed as an integral structure. Electromagnetic proportional control valves 76, 77 and 78 included in second valve block 72 are coupled and fixed to one another and formed as an integral structure. First valve block 71 and second valve block 72 are formed as separate structures.

Main operation valve 34 configured to include the plurality of direction control valves is integrated into one block.

The plurality of pilot switching valves 36 to 40 included in main operation valve 34 are formed as an integral structure, without being divided into a plurality of blocks.

Figure 4:
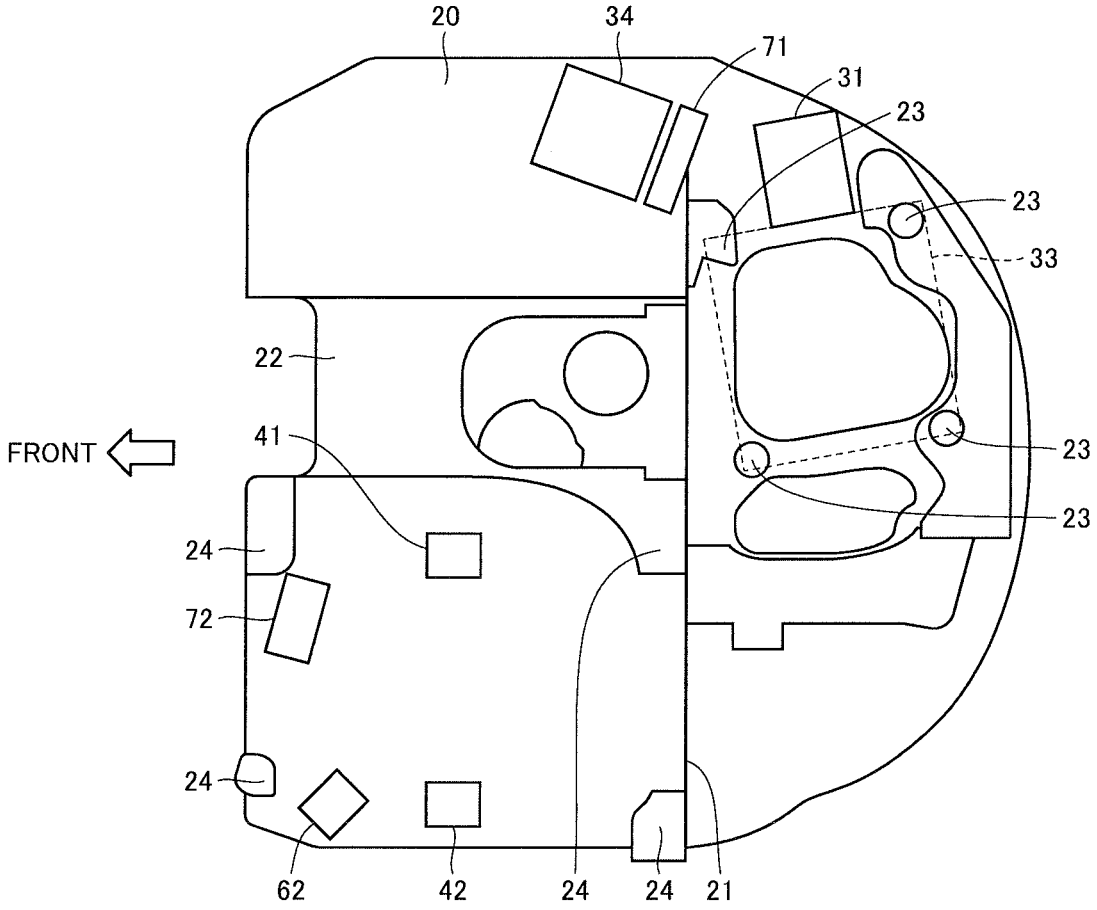
FIG. 4 is a schematic plan view showing arrangement of the respective devices on a revolving frame of the hydraulic excavator.

FIG. 4 is a schematic plan view showing arrangement of the respective devices on a revolving frame 20 of hydraulic excavator 1. As shown in FIG. 4, revolving unit 3 of hydraulic excavator 1 has revolving frame 20. Revolving frame 20 is arranged above travel unit 2 shown in FIGS. 1 and 2, and is provided to freely revolve in any directions with respect to travel unit 2.

Engine 33, and work implement 4, cab 5 and the like that are not shown in FIG. 4 are mounted on revolving frame 20 and arranged on an upper surface of revolving frame 20.

Revolving unit 3 has a partition plate 21. Partition plate 21 has a flat plate-like outline shape extending in the lateral direction and in the upward/downward direction. Partition plate 21 constitutes a front side wall of the engine compartment that accommodates engine 33. Partition plate 21 serves as a partition between cab 5 and the engine compartment. The engine compartment is defined by being covered by engine hood 6A (FIGS. 1 and 2), partition plate 21 and the counterweight (FIG. 1) from above and the side. The engine compartment is formed in the rear of revolving unit 3.

A center bracket 22 is provided at a front end portion of a central portion in the lateral direction of revolving frame 20. A base end portion of work implement 4 (FIGS. 1 and 2) is attached to center bracket 22. Center bracket 22 supports work implement 4 such that work implement 4 is rotatable with respect to revolving unit 3, and constitutes a portion where work implement 4 is attached to revolving unit 3.

Four engine mounts 23 are provided in the engine compartment. An upper surface of engine mount 23 is formed in a planar shape. The upper surface of engine mount 23 is parallel to the upper surface of revolving frame 20. Engine 33 is mounted on engine mounts 23. Engine 33 is mounted on revolving frame 20 with engine mounts 23 being interposed.

Hydraulic pump 31 is directly coupled to engine 33 and is driven by receiving the rotational driving force of engine 33. Hydraulic pump 31 is arranged on the right of engine 33. Hydraulic pump 31 is arranged in the rear of partition plate 21. Hydraulic pump 31 is arranged in a rear right corner portion of revolving frame 20.

Four cab mounts 24 are provided in the front of partition plate 21 and on the left of center bracket 22. Four cab mounts 24 are arranged at positions corresponding to the four corners of cab 5. Cab mounts 24 are mounted on revolving frame 20. Cab 5 is placed on cab mounts 24. Cab mounts 24 are interposed between cab 5 and revolving frame 20. Cab 5 is arranged above revolving frame 20 with cab mounts 24 being interposed. Cab 5 is arranged above revolving frame 20 at a distance from revolving frame 20. A hollow under-cab space is formed between a lower surface of cab 5 and the upper surface of revolving frame 20.

First control lever device 41 and second control lever device 42 are arranged in cab 5. First control lever device 41 is arranged on the right side in cab 5 such that an operator can easily operate first control lever 44 with his/her right hand. Second control lever device 42 is arranged on the left side in cab 5 such that an operator can easily operate second control lever 45 with his/her left hand. First control lever device 41 and second control lever device 42 are arranged at almost the same positions in the fore/aft direction. First control lever device 41 and second control lever device 42 are arranged as being aligned in the lateral direction. First control lever device 41 is arranged on the right of second control lever device 42. Second control lever device 42 is arranged on the left of first control lever device 41.

First pilot pressure control valve 41A, second pilot pressure control valve 41B, third pilot pressure control valve 41C, and fourth pilot pressure control valve 41D are arranged below first control lever 44. Fifth pilot pressure control valve 42A, sixth pilot pressure control valve 42B, seventh pilot pressure control valve 42C, and eighth pilot pressure control valve 42D are arranged below second control lever 45.

Pattern switching valve 62 and second valve block 72 are arranged below cab 5. Pattern switching valve 62 and second valve block 72 are arranged in the under-cab space. Pattern switching valve 62 and second valve block 72 are mounted on revolving frame 20. Pattern switching valve 62 and second valve block 72 are covered by cab 5 from above. Pattern switching valve 62 and second valve block 72 are arranged on the left of center bracket 22, and thus, are arranged on the left of work implement 4 (see also FIG. 2).

Pattern switching valve 62 is arranged near a left edge portion of the under-cab space. Pattern switching valve 62 is arranged on the left side of a center line that divides cab 5 into two equal parts in the lateral direction. Pattern switching valve 62 is arranged on the left of second valve block 72. Pattern switching valve 62 and second control lever device 42 are arranged at almost the same positions in the lateral direction. Pattern switching valve 62 is arranged near a left edge portion of revolving frame 20. Pattern switching valve 62 is arranged such that a service person can easily access to pattern switching valve 62 by opening a part of a left-side portion of the exterior panel under cab 5.

Second valve block 72 is arranged near a front edge portion of the under-cab space. Second valve block 72 is arranged on the front side of a center line that divides cab 5 into two equal parts in the fore/aft direction. Second valve block 72 is arranged to be distant from partition plate 21 toward the front in the fore/aft direction. Second valve block 72 is arranged in front of first control lever device 41 and second control lever device 42. Second valve block 72 is arranged in front of pattern switching valve 62. Second valve block 72 is arranged near a front edge portion of revolving frame 20. Second valve block 72 is arranged such that a service person can easily access to second valve block 72 by opening a part of a front-side portion of the exterior panel under cab 5.

Main operation valve 34 is arranged in front of partition plate 21. First valve block 71 is arranged in the rear of main operation valve 34. Main operation valve 34 and first valve block 71 are arranged near a right edge portion of revolving frame 20. Main operation valve 34 and first valve block 71 are covered by soil cover 6B and sheet metal cover 6C shown in FIG. 2 from above. First valve block 71 is arranged such that a service person can easily access to first valve block 71 by opening a part of sheet metal cover 6C or a part of the exterior panel below sheet metal cover 6C. Main operation valve 34 and first valve block 71 are arranged on the right of center bracket 22, and thus, are arranged on the right of work implement 4 (see also FIG. 2).

First valve block 71 and second valve block 72 are arranged to be separated from each other. First valve block 71 is arranged on the right of work implement 4. Second valve block 72 is arranged on the left of work implement 4. In the lateral direction, work implement 4 is interposed between first valve block 71 and second valve block 72. First valve block 71 and second valve block 72 are arranged on opposite sides with work implement 4 interposed therebetween.

First valve block 71 is arranged closer to main operation valve 34 than second valve block 72. First valve block 71 is arranged closer to hydraulic pump 31 than second valve block 72. Second valve block 72 is arranged below cab 5, whereas first valve block 71 is not arranged below cab 5. Second valve block 72 is arranged at a position closer to the operation apparatus (first control lever device 41 and second control lever device 42) in cab 5 than first valve block 71. First valve block 71 is arranged at a position more distant from the operation apparatus in cab 5 than second valve block 72.

Next, the function and effect of the present embodiment will be described.

According to hydraulic excavator 1 based on the embodiment, the plurality of electromagnetic proportional control valves 73 to 79 are divided into first valve block 71 including electromagnetic proportional control valves 73 to 75 and 79 and the second valve block including electromagnetic proportional control valves 76 to 78, as shown in FIG. 3. As shown in FIG. 4, first valve block 71 and second valve block 72 are arranged to be separated from each other.

Since electromagnetic proportional control valves 73 to 79 for controlling the pilot pressure are divided into two blocks, first valve block 71 and second valve block 72 can be arranged separately. As compared with a structure in which electromagnetic proportional control valves 73 to 79 are integrated into one block, each of first valve block 71 and second valve block 72 is small in volume and thus each of first valve block 71 and second valve block 72 can be arranged in a relatively small space. Therefore, by utilizing two free spaces separated from each other on revolving frame 20 of a limited area, the plurality of electromagnetic proportional control valves 73 to 79 can be appropriately arranged.

Since the plurality of electromagnetic proportional control valves 73 to 79 are divided and reduction in size of first valve block 71 and second valve block 72 is achieved, the assemblability when mounting the plurality of electromagnetic proportional control valves 73 to 79 on revolving frame 20 is improved. Since both first valve block 71 and second valve block 72 are arranged near the edge portion of revolving frame 20, access to electromagnetic proportional control valves 73 to 79 is facilitated, and thus, the maintainability of electromagnetic proportional control valves 73 to 79 can be improved.

In addition, as shown in FIG. 4, first valve block 71 and second valve block 72 are arranged on opposite sides with work implement 4 interposed therebetween. With such a configuration, first valve block 71 can be arranged in a free space on the right of work implement 4, and second valve block 72 can be arranged in a free space on the left of work implement 4.

In addition, as shown in FIG. 3, first valve block 71 includes forcible boom-raising electromagnetic proportional control valve 75 for forcibly raising boom 4A. First valve block 71 is arranged closer to main operation valve 34 than second valve block 72. With such a configuration, electromagnetic proportional control valve 75 is arranged near pilot switching valve for the boom 37 to be controlled, and thus, the responsiveness of the operation for forcibly raising boom 4A can be improved. Therefore, profile control for forcibly raising boom 4A to move a cutting edge of bucket 4C along design topography can be executed more accurately.

In addition, as shown in FIG. 4, second valve block 72 is arranged in the under-cab space provided below cab 5. With such a configuration, by utilizing the space provided below cab 5, second valve block 72 can be appropriately arranged.

In addition, as shown in FIG. 3, first valve block 71 includes arm excavation electromagnetic proportional control valve 79 for causing arm 4B to perform the excavation operation. Since eighth pilot pressure control valve 42D that outputs the hydraulic pressure signal when causing arm 4B to perform the excavation operation is a part of second control lever device 42, eighth pilot pressure control valve 42D is arranged in cab 5 as shown in FIG. 4. Since first valve block 71 is arranged in another space different from the under-cab space provided below cab 5, a distance from eighth pilot pressure control valve 42D to electromagnetic proportional control valve 79 is long. A length of eighth pilot oil passage 59 connecting eighth pilot pressure control valve 42D and electromagnetic proportional control valve 79 is long, and thus, an amount of the pilot oil in eighth pilot oil passage 59 between eighth pilot pressure control valve 42D and electromagnetic proportional control valve 79 increases.

As a result, even when a current value output to electromagnetic proportional control valve 79 by the controller fluctuates, an influence of the fluctuation is absorbed by the pilot oil in eighth pilot oil passage 59, and thus, transmission of the fluctuation to second control lever device 42 can be suppressed. Therefore, an operator who operates second control lever device 42 can comfortably operate second control lever device 42 without sensing the fluctuation.

It should be understood that the embodiment disclosed herein is illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

1 hydraulic excavator; 2 travel unit; 3 revolving unit; 4 work implement; 4A boom; 4B arm; 4C bucket; 4D, 4E, 4F hydraulic cylinder; 5 cab; 6 exterior panel; 6A engine hood; 6B soil cover; 6C sheet metal cover; 7 counterweight; 16, 17 travel motor; 20 revolving frame; 21 partition plate; 22 center bracket; 23 engine mount; 24 cab mount; 31 hydraulic pump; 33 engine; 34 main operation valve; 35 tank; 36 to 40 pilot switching valve; 41 first control lever device; 41A to 41D, 42A to 42D pilot pressure control valve; 42 second control lever device; 44 first control lever; 45 second control lever; 51, 55 pump flow path; 52 tank flow path; 53 to 54, 56 to 61 pilot oil passage; 62 pattern switching valve; 70 relay block; 71 first valve block; 72 second valve block; 73 to 79 electromagnetic proportional control valve; 80 shuttle valve; p1, p2 pilot port.

The invention claimed is:

1. A work machine comprising:

a work implement;

a plurality of hydraulic cylinders configured to drive the work implement;

an operation apparatus operated to drive the hydraulic cylinders;

a plurality of direction control valves configured to supply a hydraulic oil to the hydraulic cylinders to operate the hydraulic cylinders; and a plurality of electromagnetic proportional control valves configured to control a pressure of a pilot oil generated by operation of the operation apparatus and, in accordance with the pressure of the pilot oil, adjust a flow rate of the hydraulic oil supplied from the direction control valves to the hydraulic cylinders, the plurality of electromagnetic proportional control valves being divided into a first valve block including at least one of the electromagnetic proportional control valves and a second valve block including at least one of the electromagnetic proportional control valves, at least one of the first valve block and the second valve block includes at least two of the electromagnetic proportional control valves, and the first valve block and the second valve block being arranged to be separated from each other.

2. The work machine according to claim 1, wherein the first valve block and the second valve block are arranged on opposite sides with the work implement interposed therebetween.

3. The work machine according to claim 1, wherein the work implement includes a boom, the plurality of electromagnetic proportional control valves include a forcible boom-raising valve for forcibly raising the boom, the first valve block includes the forcible boom-raising valve, and the first valve block is arranged closer to the direction control valves than the second valve block.

4. The work machine according to claim 1, further comprising a cab on which an operator gets, wherein the operation apparatus is arranged in the cab, and the second valve block is arranged below the cab.

5. The work machine according to claim 4, wherein the work implement includes a boom and an arm configured to be rotatable with respect to the boom, the plurality of electromagnetic proportional control valves include an arm excavation valve for causing the arm to perform an excavation operation, and the first valve block includes the arm excavation valve.

6. The work machine according to claim 1, wherein the electromagnetic proportional control valves of the first valve block are coupled and fixed to one another to form an integral structure, and wherein the electromagnetic proportional control valves of the second valve block are coupled and fixed to one another to form an integral structure.

7. The work machine according to claim 1, wherein the first valve block is arrange near a right edge portion of a revolving frame of the work machine, and the second valve portion is arranged near a front edge of the revolving frame.

* * * * *